US007779916B2

(12) United States Patent
Zemlak et al.

(10) Patent No.: US 7,779,916 B2
(45) Date of Patent: Aug. 24, 2010

(54) APPARATUS FOR SUBSEA INTERVENTION

(75) Inventors: Warren M. Zemlak, Moscow (RU); John A. Kerr, St Nom la Breteche (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 354 days.

(21) Appl. No.: 11/566,258

(22) Filed: Dec. 4, 2006

(65) Prior Publication Data

US 2008/0105432 A1 May 8, 2008

Related U.S. Application Data

(63) Continuation-in-part of application No. 10/709,322, filed on Apr. 28, 2004, now Pat. No. 7,264,057, which is a continuation of application No. 09/920,896, filed on Aug. 2, 2001, now Pat. No. 6,763,889.

(60) Provisional application No. 60/225,230, filed on Aug. 14, 2000, provisional application No. 60/225,440, filed on Aug. 14, 2000, provisional application No. 60/225,439, filed on Aug. 14, 2000, provisional application No. 60/745,364, filed on Apr. 21, 2006.

(51) Int. Cl.
*E21B 23/00* (2006.01)

(52) U.S. Cl. ..... 166/336; 166/339; 166/341; 166/344; 166/352; 166/353; 166/367; 166/385

(58) Field of Classification Search ..... 166/336, 166/338–341, 344, 345, 352–355, 366–368, 166/385

See application file for complete search history.

(56) References Cited

U.S. PATENT DOCUMENTS 3,313,346 A 4/1967 Cross
3,531,761 A * 9/1970 Clift, Jr. et al. ..... 367/17
3,531,762 A * 9/1970 Tickell ..... 367/17
3,701,859 A 10/1972 Braun et al.
4,326,312 A * 4/1982 Tang ..... 441/5
4,577,693 A 3/1986 Graser
4,673,041 A 6/1987 Turner et al.
4,762,180 A 8/1988 Wybro et al.

(Continued)

FOREIGN PATENT DOCUMENTS

EP 1216342 B1 12/2005

(Continued)

*Primary Examiner*—Thomas A Beach
*Assistant Examiner*—Matthew R Buck
(74) *Attorney, Agent, or Firm*—Myron K. Stout

(57) ABSTRACT

A subsea intervention system is disclosed comprising a floating vessel and a source of coiled tubing at the floating vessel. The system includes a seabed installation including a wellhead and compliant guide having one end operatively connected to the floating vessel and the second end operatively connected to the seabed installation. The compliant guide provides a conduit between the floating vessel and the wellhead for the coiled tubing. At least one injector is present at the floating vessel for inserting the coiled tubing into the compliant guide, and a carousel is proximate the wellhead which comprises a plurality of chambers with intervention tools in at least two of those chambers. The system may also include a plurality of sensing units that are disposed at spaced intervals along the compliant guide to monitor various aspects of the compliant guide and to transmit that information to a repositioning system.

16 Claims, 6 Drawing Sheets

U.S. PATENT DOCUMENTS

| | | | | | |
|---|---|---|---|---|---|
| 4,768,984 | A | | 9/1988 | de Oliveira et al. | |
| 4,789,269 | A | * | 12/1988 | Ayers et al. | 405/158 |
| 4,899,823 | A | | 2/1990 | Cobb et al. | |
| 4,986,360 | A | | 1/1991 | Laky et al. | |
| 5,002,130 | A | | 3/1991 | Laky | |
| 5,671,811 | A | * | 9/1997 | Head | 166/346 |
| 5,826,654 | A | * | 10/1998 | Adnan et al. | 166/250.01 |
| 5,857,523 | A | | 1/1999 | Edwards | |
| 5,914,596 | A | * | 6/1999 | Weinbaum | 324/228 |
| 6,015,013 | A | | 1/2000 | Edwards et al. | |
| 6,053,252 | A | | 4/2000 | Edwards | |
| 6,116,345 | A | | 9/2000 | Fontana et al. | |
| 6,182,765 | B1 | * | 2/2001 | Kilgore | 166/381 |
| 6,276,456 | B1 | * | 8/2001 | Head | 166/359 |
| 6,321,596 | B1 | * | 11/2001 | Newman | 73/152.45 |
| 6,386,290 | B1 | * | 5/2002 | Headworth | 166/346 |
| 6,488,093 | B2 | * | 12/2002 | Moss | 166/339 |
| 6,659,180 | B2 | * | 12/2003 | Moss | 166/339 |
| 6,671,223 | B2 | * | 12/2003 | Bittleston | 367/19 |
| 6,675,888 | B2 | * | 1/2004 | Schempf et al. | 166/65.1 |
| 6,834,724 | B2 | * | 12/2004 | Headworth | 166/384 |
| 6,843,321 | B2 | * | 1/2005 | Carlsen | 166/355 |
| 7,000,903 | B2 | * | 2/2006 | Piecyk et al. | 254/268 |
| 7,080,557 | B2 | * | 7/2006 | Adnan | 73/622 |
| 7,264,057 | B2 | * | 9/2007 | Rytlewski et al. | 166/338 |
| 2002/0040783 | A1 | | 4/2002 | Zimmerman et al. | |
| 2005/0189115 | A1 | * | 9/2005 | Rytlewski et al. | 166/344 |
| 2005/0217844 | A1 | * | 10/2005 | Edwards et al. | 166/85.1 |
| 2007/0175639 | A1 | * | 8/2007 | Hoen | 166/336 |

FOREIGN PATENT DOCUMENTS

| | | | |
|---|---|---|---|
| GB | 2320268 | A | 6/1998 |
| WO | 03031765 | A1 | 4/2003 |
| WO | 2006000362 | A2 | 1/2006 |
| WO | 2006003362 | A1 | 1/2006 |
| WO | 2006027553 | A1 | 3/2006 |

* cited by examiner

APPARATUS FOR SUBSEA INTERVENTION

CROSS-REFERENCE TO RELATED APPLICATION

This application is a continuation-in-part of U.S. patent application Ser. No. 10/709,322, filed Apr. 28, 2004, now U.S. Pat. No. 7,264,057, which is a continuation of U.S. patent application Ser. No. 09/920,896, filed Aug. 2, 2001, now U.S. Pat. No. 6,763,889, which claims the benefit under 35 U.S.C. §119(e) of U.S. Provisional Applications Serial Nos. 60/225,230, filed Aug. 14, 2000; 60/225,440, filed Aug. 14, 2000; and 60/225,439, filed Aug. 14, 2000. This application also claims the benefit under 35 U.S.C. §119(e) of U.S. Provisional Application Serial No. 60/745,364, filed Apr. 21, 2006.

BACKGROUND

1. Field of the Invention

The present invention relates to apparatus for making subsea interventions and more particularly for making such interventions using a spoolable compliant guide.

2. Description of the Prior Art

An operator may perform a subsea well intervention for various reasons including, for example, in response to a drop in production or some other problem in the subsea well. Such an intervention operation may involve running a monitoring tool into the subsea well to identify the problem, and depending on the type of problem encountered, the intervention may further include such steps as shutting in one or more zones, pumping a well treatment into a well, or lowering tools to actuate downhole devices (e.g., valves).

The performance of a conventional subsea intervention requires the operator to deploy a rig (such as a semi-submersible rig) or a vessel, as well as a marine riser, which is a large diameter tubing that extends from the rig or vessel to the subsea wellhead equipment. Performing intervention operations with large vessels and heavy equipment such as marine riser equipment is typically time consuming, labor intensive, and expensive. Accordingly, such conventional intervention is only performed when economics and risks are favorable. In other cases, the well performance is simply accepted without intervention. As a result, subsea wells typically produce less and for a shorter duration than platform wells.

Many subsea well operators attempt to predict future needs of the subsea wells by installing expensive completion equipment that would enable the subsea wells to fulfill these future needs without the necessity of performing a well intervention operation. Installation of such equipment substantially increases the cost to complete the subsea well. However, since the reservoir description and its dynamic behavior are usually better deciphered and understood over time, it is likely that some anticipated future needs might not materialize and some unexpected ones might appear. In other words, some of the costly completion equipment may never be utilized and equipment which turns out to be needed may not be present at the subsea wells. Nonetheless, many subsea well operators install this expensive completion equipment and accept the consequences, whatever way they may turn out, instead of performing an intervention.

A spoolable compliant guide ("SCG") has been proposed for use in a subsea intervention operation. An SCG is constructed as a hollow tube which may be continuous or jointed, and has a first end for engagement with a floating vessel and a second end engaging a subsea wellhead. The SCG acts as a conduit between the floating vessel and the subsea wellhead for coiled tubing. Such an SCG is described in U.S. Pat. No. 6,386,290 to Headworth, which is owned by the Assignee of the present application and which is incorporated herein by reference.

SUMMARY OF THE INVENTION

In accordance with the present invention, a subsea intervention system is provided which comprises a floating vessel with a source of coiled tubing at the floating vessel. The system further includes a seabed installation which includes a wellhead, and a compliant guide having first and second ends. The first end of the compliant guide is operatively connected to the floating vessel and the second end of the compliant guide is operatively connected to the seabed installation. This compliant guide provides a conduit between the floating vessel and the wellhead for the coiled tubing. A system in accordance with the present invention also includes at least one injector at the floating vessel for inserting the coiled tubing into the compliant guide.

A subsea carousel is provided proximate the wellhead which comprises a plurality of chambers with intervention tools in at least two of said chambers. The coiled tubing utilizes the tools in the carousel during intervention procedures. The intervention tools that are present in the chambers of the carousel may, for example, be bottom hole assemblies, crown plugs and intervention work tools.

In one embodiment of the system of the present invention, the carousel is operatively connected to the second end of the compliant guide as the compliant guide is lowered to the seabed installation. In yet another embodiment of the present invention, the carousel is operatively connected to and is part of the seabed installation.

A system according to the present invention may further comprise a plurality of sensing units which are disposed at spaced intervals along the compliant guide. The sensing units function to measure the magnitude and direction of forces acting on the compliant guide and to transmit that information to vessel repositioning apparatus located proximate the floating vessel. The vessel repositioning apparatus utilizes the information from the sensors to reposition the floating vessel as required. The various sensors that are disposed on the compliant guide may also be used to monitor a variety of aspects of the compliant guide, including its radius, pressure, ovality, wall thickness and movements in three-dimensional space.

DESCRIPTION OF SPECIFIC EMBODIMENTS

It will be appreciated that the present invention may take many forms and embodiments. In the following description, some embodiments of the invention are described and numerous details are set forth to provide an understanding of the present invention. Those skilled in the art will appreciate, however, that the present invention practiced without those details and that numerous variations from and modifications of the described embodiments may be possible. The following description is thus intended to illustrate and not limit the present invention.

Figure 1:
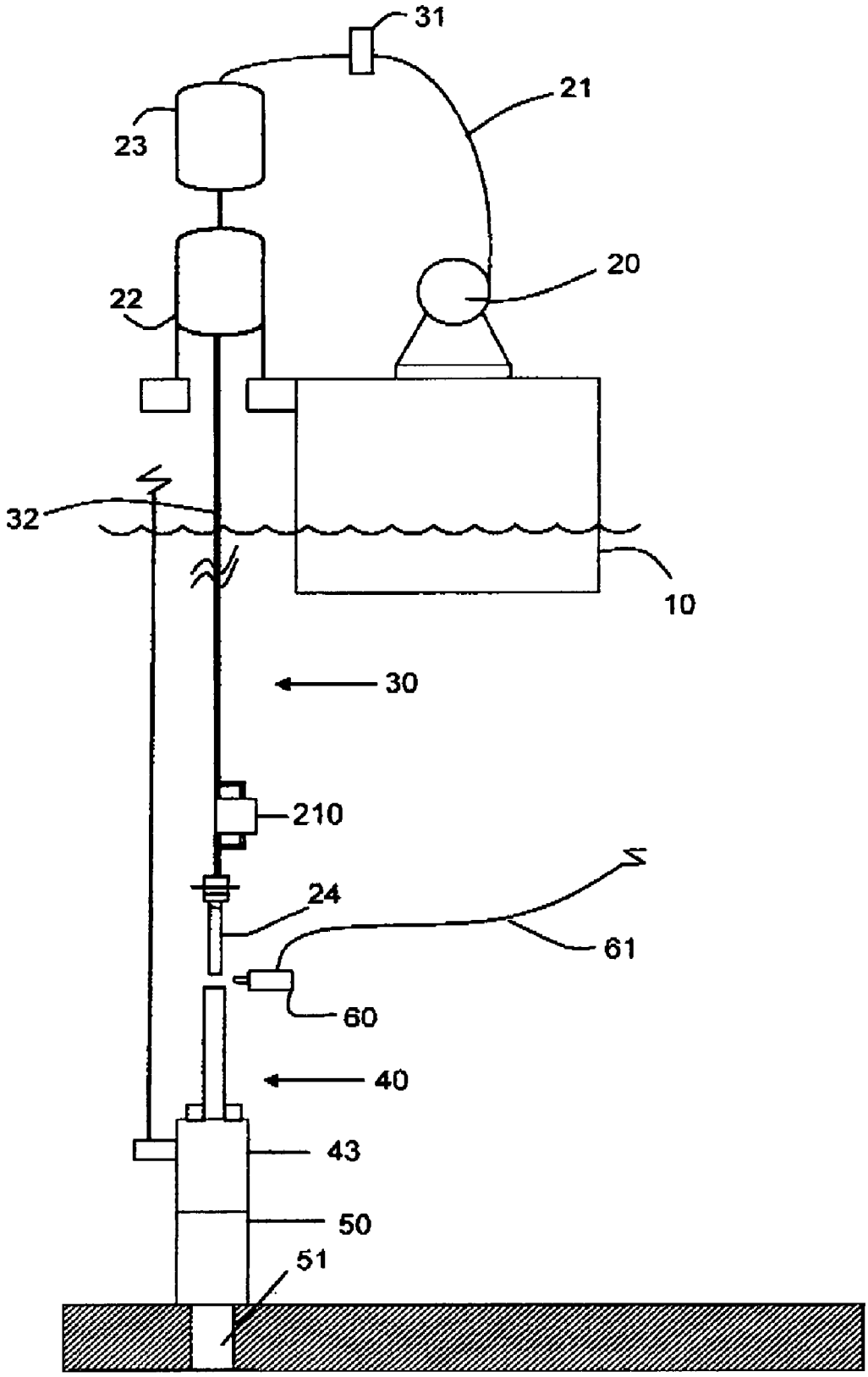
FIG. 1 is an elevation view which illustrates an SCG being lowered to a subsea assembly.
Figure 2:
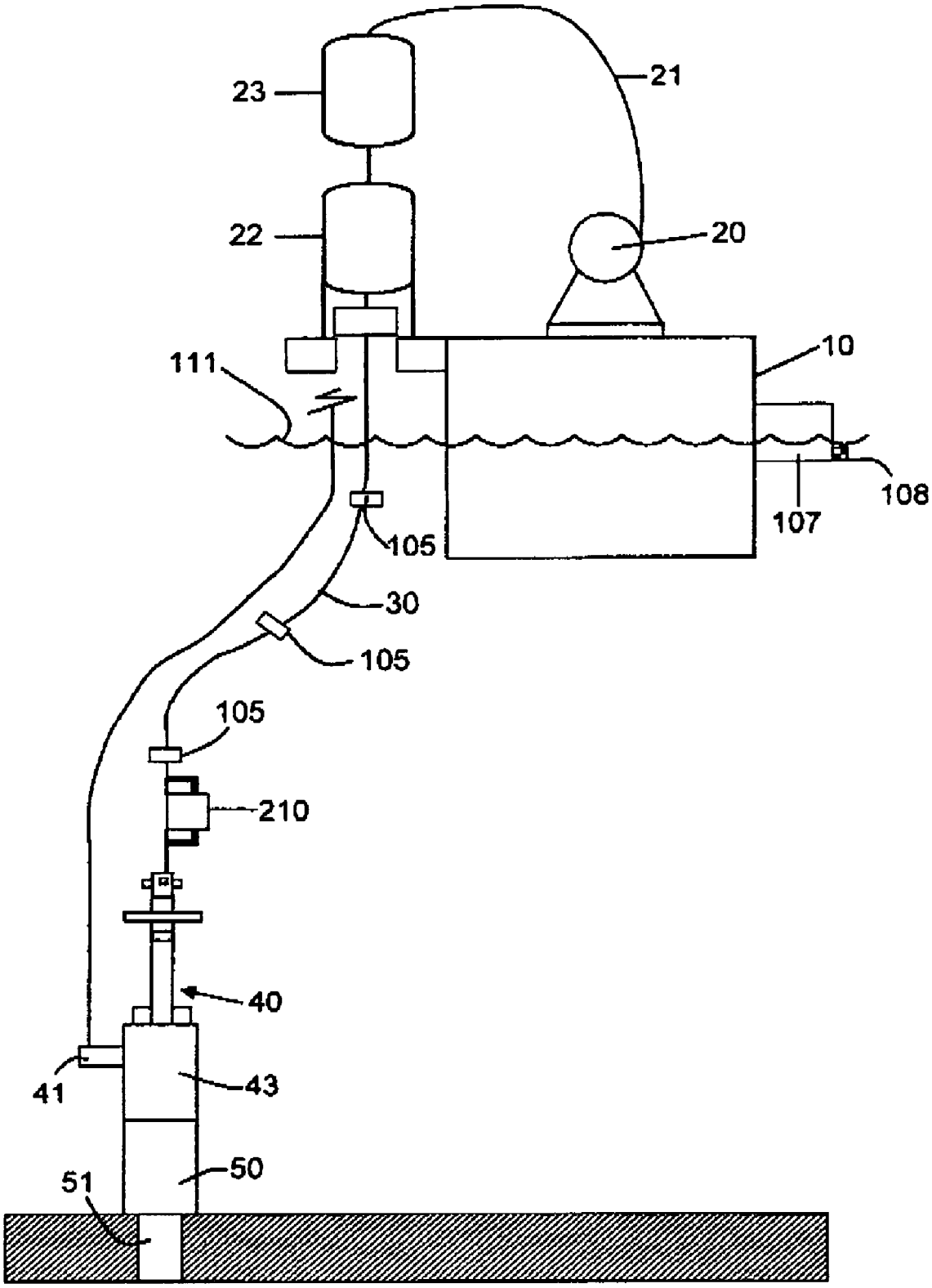
FIG. 2 is an elevation view which illustrates the SCG of FIG. 1 as it assumes a desired compliant shape.

Referring now to FIGS. 1 and 2, an SCG 30 is illustrated being lowered to the subsea lubricator 40 by two injectors 22, 23 in series. Injectors 22 and 23 are utilized to lower SCG 30, and to push coiled tubing from coiled tubing assembly 21 into SCG 30. A remote operated vehicle 60 guides the tool string 24 into the subsea lubricator 40, which has a larger inside diameter than the outside diameter of the tool string 24. The SCG 30 and coiled tubing 21 assembly may be lowered until the coiled tubing tool string 24 is fully inserted into, and the latching apparatus 36 mates with, the subsea lubricator 40. The SCG 30 continues to be unspooled until it assumes a desired compliant shape as illustrated in FIG. 2 and until it is clear of the injectors 23, 24.

The SCG 30 is of sufficient length to reach between the floating vessel 10 and the subsea lubricator 40 and assumes a compliant shape, while the coiled tubing 21 is of sufficient length to penetrate to the depths of the well 51 and is generally much longer than the SCG 30.

The compliant quality of the SCG 30 as it extends from the subsea lubricator 40 to the floating vessel 10 enables dynamic bending and thus provides a means of compensation for the heave motions of the floating vessel 10 and thereby avoids the need for special heave compensation devices for both the SCG 30 and the injectors 22 and 23.

The SCG 30 may also include secondary force sensing units 105 located at a plurality of positions along the length of the SCG 30. These units 105 contain sensors, associated electronics to determine the magnitude and direction of forces acting on the SCG 30 at positions 106*a-c* as well as communication hardware and software (not shown) for transmitting the information to a vessel response unit 107 which includes communication electronics, communication hardware and software (not shown) and a vessel repositioning apparatus 108 such as a propeller.

Apparatus according to the present invention has the following features, namely: (a) stress/strain analysis modeling of the SCG; (b) a subsea handling system; (c) a subsea carousel for storing intervention tools; and (d) a solids filtering mechanism. Each of these features is discussed below.

Stress/Strain Analysis Modeling of the SCG

Figure 3:
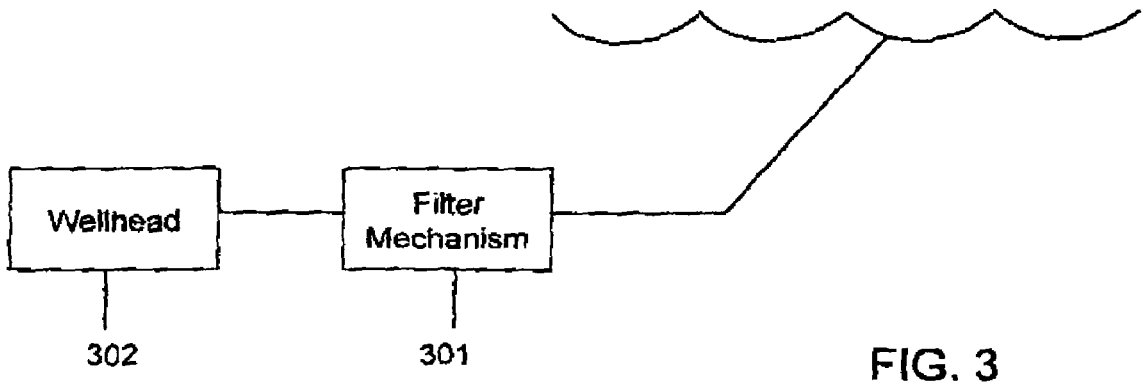
FIG. 3 is a schematic diagram which illustrates a filter mechanism disposed between a wellhead and a flowline.

In accordance with the present invention, the fatigue and life of SCG 30 may be modeled in real time as the SCG 30 moves and bends under the sea. Various techniques may be directed to monitoring the stress and movement of the SCG 30, analyzing the data and determining the remaining life of SCG 30. Various parameters that may be monitored include radius, pressure, ovality of the tubing, wall thickness, x, y and z movements, and the like. These parameters may be measured using various sensors and the fiber optic disposed along the SCG 30. Examples of those sensors may include the sensor units 105 shown in FIG. 3. In one implementation, a GPS may be used in monitoring those parameters. The life value of the SCG 30 may then be used to replace or adjust the SCG 30 prior to it reaching a failure stress point. Various methods for modeling stress strain on a wireline coiled tubing system may be described in commonly assigned U.S. Pat. No. 5,826,654 entitled MEASURING RECORDING AND RETRIEVING DATA ON COILED TUBING SYSTEM and U.S. patent application Ser. No. 11/212,047 entitled METHODS OF USING COILED TUBING INSPECTION DATA, which are incorporated herein by reference.

In this manner, various stress/strain parameters of the SCG 30 may be monitored and analyzed. The life remaining in the SCG 30 may then be calculated based on the stress/strain parameters.

Subsea Handling System

Various technologies may also be directed to a subsea handling system, which may be defined as an equipment for deploying the SCG 30 into the sea. In one implementation, the subsea handling system may include a cantilever, which may be disposed at the back or the side of a vessel. In another implementation, the subsea handling system may include a heave compensation mechanism. The subsea handling system may enable any common vessel having a large deck space to be used for deploying the SCG 30, thereby eliminating the necessity of using only vessels having a moon pool. However, the subsea handling system may also be used with a vessel having a moon pool.

The primary purpose of the subsea handling system is to manage the safe handling of a subsea well control system from the back of a supply class or anchor handling vessel. In one implementation, the subsea handling system may be a stand alone equipment with respect to the vessels structure, thereby forming an integral part of the well intervention spread itself.

The subsea handling system may utilize a number of deployment means, such as a high tensile cable, a plasma style rope, or coiled tubing.

In one implementation, the subsea handling system may include a deck skidding system, an a-frame (or similar) style heavy lift crane, a cursor launching/receiving system (to all safe passage of the lifted package through the splash zone).

The subsea handling system may be configured to manage the handling of the package across its entire axis of freedom, limiting any movement while deploying or retrieving the hardware to/from the seabed.

The deployment/retrieval system may use a series of hydraulically operated arms to alter the hardware from the horizontal to the vertical planes (or vice versa). This system may also include a platform where the complete well control and lubricator section of the subsea hardware is supported and maneuvered from horizontal to vertical, with the vertical position being located directly above the cursor launching system either at the rear or on the side of vessel.

In one implementation, the subsea handling system may include an integral active heave compensation system In another implementation, the subsea handling system may use an "anchor handling vessels anchor forks" as a method of support the lift load or cantilever loads.

In yet another implementation, the lifting/landing system may include a plasma rope system for use in making up the well control package to the subsea Christmas tree. This system may include either surface or subsea winches for final stages of make-up.

Solids Filtering Mechanism

Figure 4:
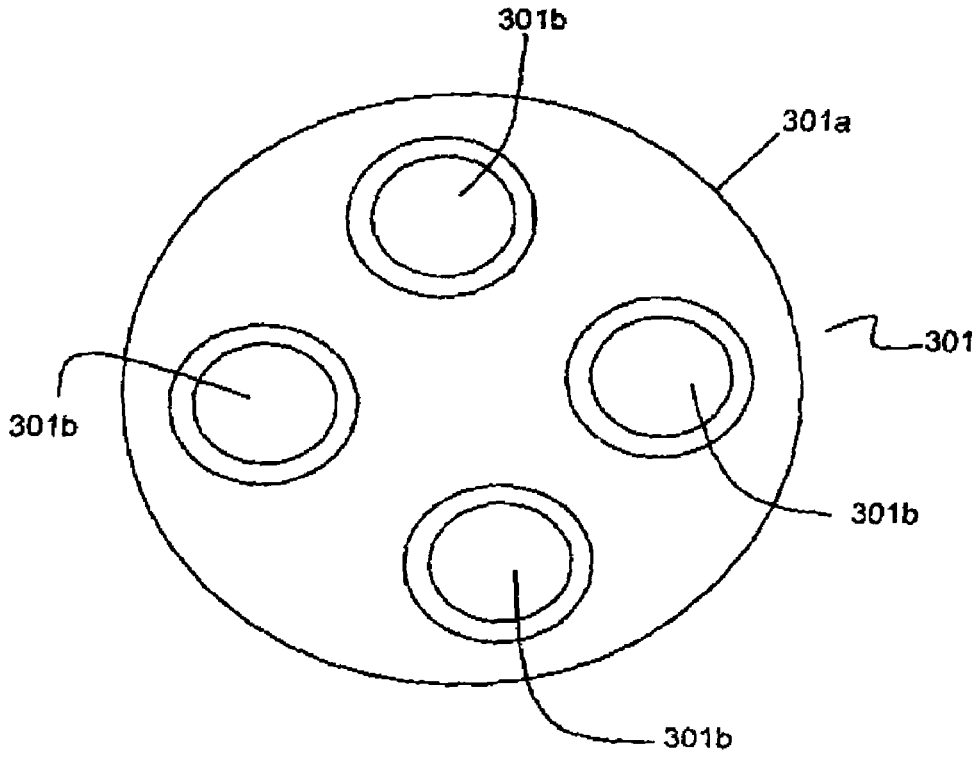
FIG. 4 is a top view of one embodiment of a filter mechanism as illustrated in FIG. 3.

Subsea wellheads are typically connected to each other using flow lines, which may then be connected to a production tubing to the surface. In addition to fluids, the well may produce unwanted solids. Accordingly, various technologies may be directed to a filter mechanism 301 disposed between a wellhead 302 and a flow line for filtering unwanted solids from the wellhead, as schematically shown on FIG. 3. An ROV may be used to position such filter mechanisms. In one implementation, the filter mechanism 301 may include a cylindrical body 301*a* having a number of slots 301*b* contained therein, as illustrated in FIG. 4. A filter cartridge (not shown) may be disposed in each slot 301*b*. Such a filter mechanism 301 may be configured to be used with a number of wellheads on the sea floor. By using the filter mechanism 301, fluids from the wellhead may be produced to the surface with minimal unwanted solids.

Subsea Carousel/Revolver for Storing Intervention Tools

The time it would take the SCG 30 down to the sea floor and secure it to the wellhead may be hours, even days. Accordingly, it would be desirable to minimize the number of times the SCG 30 is brought up to the surface. Various intervention work tools, bottom hole assemblies (BHA's), crown plugs and the like may be used as part of a subsea intervention on a wellhead.

Implementations of various technologies described herein may be directed to a revolver/carousel type storage unit having slots or launch tubes disposed therein. Each slot may be configured to store an intervention work tool, a BHA, a crown plug and the like during a subsea intervention. The storage unit may be configured to rotate to facilitate access to various tools and crown plugs stored in the slots.

Figure 5:
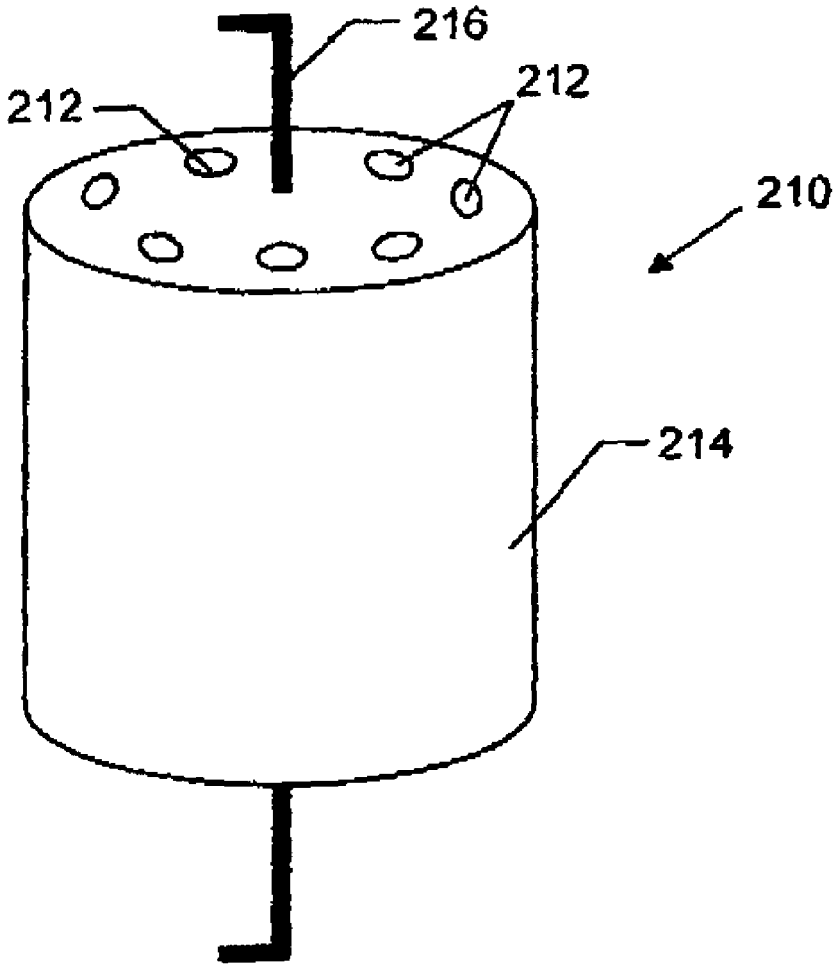
FIG. 5 is a perspective view of the carousel 210 which is illustrated in FIGS. 1 and 2.

FIG. 5 illustrates a carousel storage unit 210 that may be used in accordance with the present invention. The carousel storage unit 210 may be used to enable easy exchange of intervention tools attached to the SCG 30 without retrieving the SCG 30 all the way back to the sea vessel. As further shown in FIG. 5, the carousel storage unit 210 may have a rotatable structure 214 with a plurality of chambers 212, where each chamber containing a respective intervention tool. The rotatable structure 214 may be rotatable about an axis 216. In one implementation, depending on the desired type of intervention tool, the rotatable structure 214 is rotated so that the appropriate chamber 212 may be aligned with the wellhead. The coiled tubing may be lowered into the chamber 212 for engagement with the tool in the chamber 212. Further downward movement of the coiled tubing may cause the tool to be run into the wellbore.

After the first intervention operation has been completed, the coiled tubing may be raised. The intervention tool connected at the end of the coiled tubing may be raised into the corresponding chamber 212, where the intervention tool is unlatched from the coiled tubing. The coiled tubing may be raised out of the storage unit 210. Subsequently, the storage unit 210 may be actuated and the rotatable structure 214 may be rotated so that another chamber 212 containing another type of intervention tool is aligned with the wellhead. The coiled tubing may again be lowered into chamber 212, where it engages the next intervention tool. Another intervention operation may then be performed. This process may be repeated until all desired intervention operations possible with tools contained in the storage unit 210 have been performed.

In one embodiment, carousel 210 is operatively connected to SCG30 as SCG30 is lowered. In another embodiment, carousel 210 is operatively connected to and is part of the wellhead.

As indicated above, the slots or launch tubes may be accessible to the wellbore by either a carousel design method, independent tubes activated to centerline of bore by hydraulic means, by way of a linear sliding cassette, or by an automated tool changer (similar to a machine tool—tool handler/changer). The number of launch tubes may depend on the desired campaign. It is envisioned that the storage unit may include as many as 12 launch tubes or more.

The launch tubes may contain hydraulic rams, which may be used in the removal and replacement of Christmas tree plugs. The storage unit may allow a single ram to be located over the wellbore centerline and through hydraulic extension of the ram, lock onto the top of the HXT plug and retrieve plug. The end assembly of the ram may have a device that may allow accelerated forces onto the plug locking device to encourage movement.

The upper end of the launch tubes may have a remotely latchable interface to allow an internal coiled tubing workstring (deployed from surface) to latch onto the tool located within tube. The same device may have an automated capability that once workstring has completed its in-well activity and returned the tool back into the tube, it can be disconnected from the tool, allowing the coiled tubing to return to surface leaving tool subsea.

The internals of the launching system may either be exposed to hydrocarbons at all times, or have the ability to be purged and operate in a manner similar to an airlock.

In one implementation, the storage unit may be attached to the wellhead, perhaps below the stripper. In another implementation, the storage unit may be mounted either above or below the subsea well control package.

The storage unit may be controlled remotely from the surface using a control line. In one implementation, the storage unit may be remotely controlled from the surface by direct or multiplexed control methods. The control of the storage unit may have an interlock with the well control settings of the subsea package.

The storage unit may be used in connection with a compliant coiled tubing riser where the i.d. of the riser is smaller than the required tool/device entering the well.

The storage unit may contain internal cameras for monitoring the activity within the launch tubes or the latching of the plugs.

The storage unit may have an inlet and outlet to allow the flushing of any hydrocarbons from within. The returns may either be transferred back into the subsea well or returned to surface for handling.

Rudders for Controlling Movements of SCG

If the SCG 30 is exposed to strong currents, such as those in Gulf of Mexico, the SCG 30 may have several locked up points due to forces caused by opposing currents. Accordingly, various technologies may be directed to attaching a plurality of rudders along the SCG 30 for controlling the movements of the SCG 30. The rudders may be horizontal rudders or vertical rudders. Various parameters, e.g., the pitch, angle and the like, of the rudders, may be controlled by the various sensors and the fiber optic line disposed along the SCG 30. In this manner, the rudders may be used to control the geometry of the SCG 30. In one implementation, the rudders may be used to move the SCG 30 from one wellhead to another wellhead. In another implementation, the rudders may be used in combination with the buoyancy/air bags. In yet another implementation, the rudders may be used in lieu of the buoyancy mechanisms/air bags.

Figure 6:
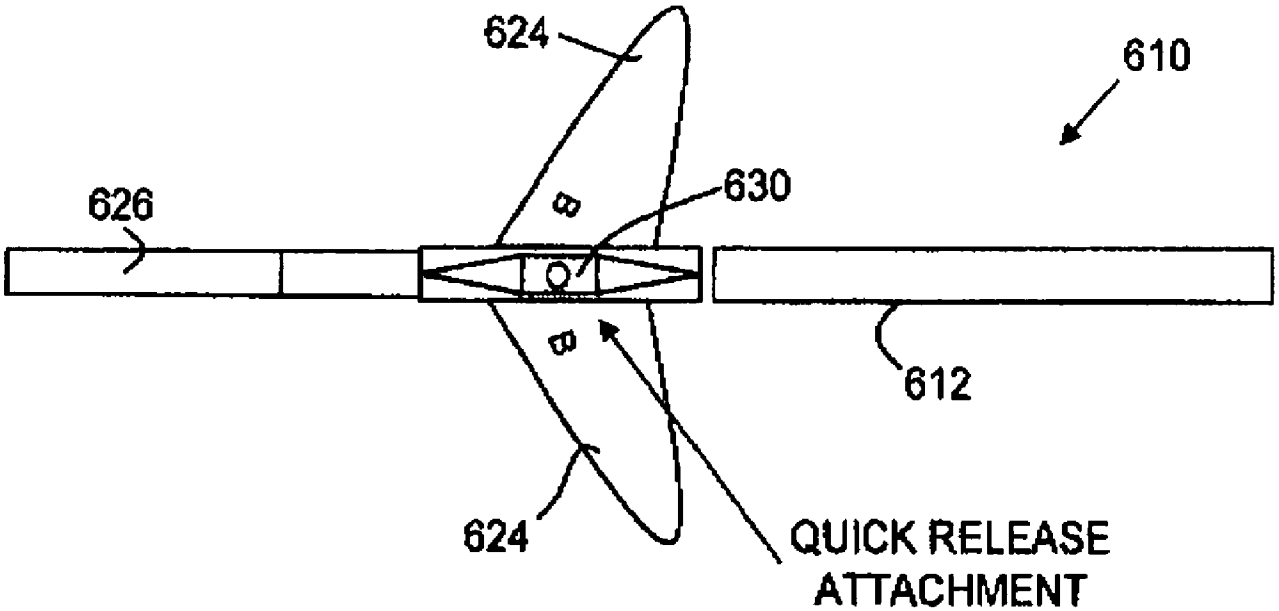
FIG. 6 is a top view of a rudder assembly which may be utilized in the system of the present invention.

FIG. 6 schematically illustrates a rudder assembly 610 in accordance with implementations of various technologies described herein. The rudder assembly 610 is provided with two opposed control surfaces, or wings, 624, which may be molded from a fiber-reinforced plastics material, which project horizontally outwardly from the body 612 and which may be independently rotatable about a common axis extending substantially perpendicularly through the longitudinal axis of the body. Rotation of the wings 624 may be controlled by a control system 626 sealingly housed within the body 612. To facilitate the rapid removal and reattachment, the wings 624 may be secured to body 612 by a quick-release attachment 630.

Figure 7:
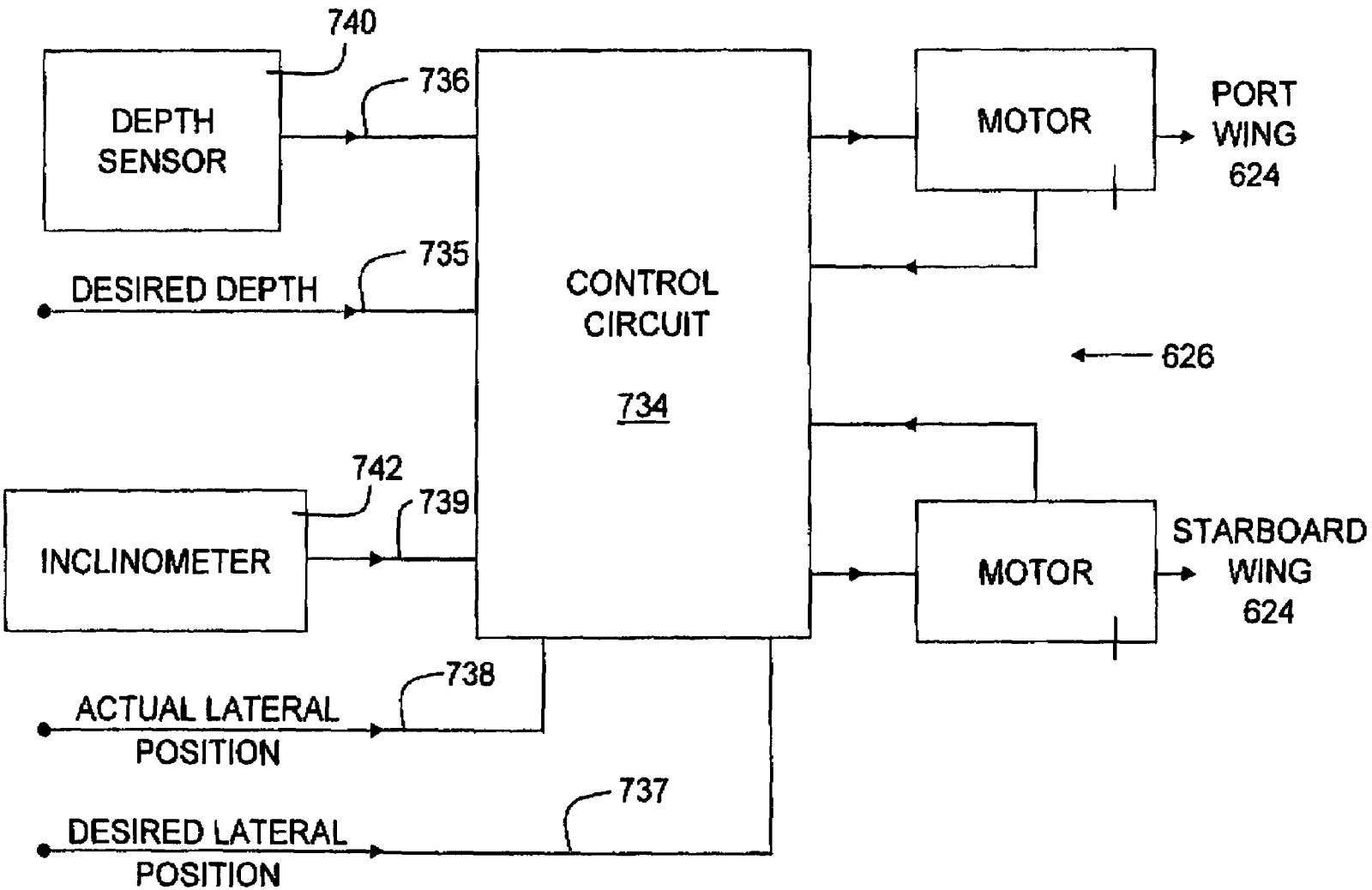
FIG. 7 is a schematic diagram in block diagram form of the control system 626 illustrated in FIG. 6.

FIG. 7 illustrates the control system 626 of FIG. 6 in more detail. In particular, the control system 626 may include a microprocessor-based control circuit 734 having respective inputs 735 to 739 to receive control signals representative of desired depth 735, actual depth 736, desired lateral position 737, actual lateral position 738 and roll angle 739 of the rudder 610. The desired depth signal can be either a fixed signal corresponding to the aforementioned 10 meters, or an adjustable signal, while the actual depth signal is typically produced by a depth sensor 740 mounted in or on the rudder 610. The roll angle signal 739 may be produced by an inclinometer 742 mounted within the rudder 610.

What is claimed is:

1. A subsea intervention system, comprising:

a floating vessel;

a source of coiled tubing at the floating vessel;

a seabed installation including a wellhead;

a riser having first and second ends, said first end being operatively connected to said floating vessel and said second end operatively connected to said seabed installation, the riser providing a conduit between the floating vessel and the wellhead for the coiled tubing;

at least one injector at the floating vessel for pushing the coiled tubing into the riser; and a carousel proximate the wellhead comprising a plurality of chambers with intervention tools in at least two of said chambers, wherein the riser is a compliant guide, wherein the system further comprises a plurality of sensing units disposed at spaced intervals along the compliant guide, wherein the sensing units monitor the radius, pressure, ovality, wall thickness and movements in three-dimensional space of the compliant guide, and wherein the compliant guide includes a rudder assembly comprising a plurality of opposed control surfaces or wings rotatable about an axis extending substantially perpendicularly to an axis of the compliant guide for controlling movement of the compliant guide, and wherein the rotation of the plurality of opposed control surfaces or wings is controlled by sensors and a fiber optic line disposed along the compliant guide.

2. The system of claim 1, wherein said intervention tools are selected from the group consisting of bottom hole assemblies, crown plugs and intervention work tools.

3. The system of claim 1, wherein the carousel is operatively connected to the second end of the compliant guide as the compliant guide is lowered to the seabed installation.

4. The system of claim 1, wherein the carousel is operatively connected to and is part of the seabed installation.

5. The system of claim 1, wherein the sensing units function to measure the magnitude and direction of forces acting on the compliant guide and to transmit that information to a vessel response unit located proximate the floating vessel.

6. The system of claim 5, further comprising vessel repositioning apparatus which utilizes the information from the sensors to reposition the floating vessel.

7. The system of claim 1, wherein the sensors and the fiber optic line control pitch and angle of the plurality of opposed control surfaces or wings.

8. The system of claim 1, wherein the rudder assembly is configured to move the complaint guide from a first wellhead to a second wellhead.

9. The system of claim 1, wherein the rudder assembly is used in combination with a buoyancy device, including an air bag.

10. The system of claim 1, wherein the rudder assembly includes a housing having the plurality of opposed control surfaces or wings molded from a fiber-reinforced plastics material, and which project horizontally outwardly from the housing and which are independently rotatable about a common axis extending substantially perpendicularly through a longitudinal axis of the housing.

11. The system of claim 10, wherein rotation of the opposed control surfaces or wings are controlled by a control system housed within the housing.

12. The system of claim 10, wherein the opposed control surfaces or wings are secured to the housing by a quick-release attachment device.

13. The system of claim 11, wherein the control system includes a microprocessor-based control circuit configured to receive control signals representative of desired depth, actual depth, desired lateral position, actual lateral position, and roll angle of the rudder assembly.

14. The system of claim 13, wherein the desired depth signal is a fixed signal corresponding to a predetermined depth, and an actual depth signal is provided by a depth sensor mounted in or on the rudder assembly.

15. The system of claim 13, wherein the desired depth signal is an adjustable signal corresponding to an adjustable depth, and an actual depth signal is provided by a depth sensor mounted in or on the rudder assembly.

16. The system of claim 13, wherein the roll angle signal is provided by an inclinometer mounted in or on the rudder assembly.

* * * * *